US010927524B2

(12) United States Patent
Gerber et al.

(10) Patent No.: US 10,927,524 B2
(45) Date of Patent: Feb. 23, 2021

(54) RETRIEVAL ARRANGEMENT FOR A RIPPER OF A MACHINE

(71) Applicant: Caterpillar Inc., Deerfield, IL (US)

(72) Inventors: Byron Lynn Gerber, Roanoke, IL (US); Kelly Ann Scholz, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 7 days.

(21) Appl. No.: 16/028,561

(22) Filed: Jul. 6, 2018

(65) Prior Publication Data

US 2020/0011024 A1 Jan. 9, 2020

(51) Int. Cl.

| | |
|---|---|
| ***A01B 13/08*** | (2006.01) |
| ***A01B 63/02*** | (2006.01) |
| ***E02F 5/32*** | (2006.01) |
| ***E02F 9/00*** | (2006.01) |
| *E02F 3/96* | (2006.01) |

(52) U.S. Cl.

CPC ..... *E02F 9/003* (2013.01); *E02F 5/32* (2013.01); *E02F 3/961* (2013.01)

(58) Field of Classification Search

CPC ... E02F 9/003; E02F 5/32; E02F 3/961; E02F 5/323; E02F 5/326; A01B 13/00; A01B 13/08; A01B 63/118

See application file for complete search history.

(56) References Cited

U.S. PATENT DOCUMENTS

| | | | | |
|---|---|---|---|---|
| 2,262,415 | A | 11/1941 | Williams et al. | |
| 2,490,904 | A * | 12/1949 | Gustafson | E02F 5/32 172/611 |
| 2,552,292 | A * | 5/1951 | Metz et al. | A01B 13/08 172/683 |
| 2,732,196 | A | 1/1956 | Wood | |
| 3,022,836 | A * | 2/1962 | Bechman | A01B 13/00 172/698 |
| 3,752,239 | A * | 8/1973 | Kelley | E02F 5/32 172/699 |
| 4,010,805 | A * | 3/1977 | Kelley | A01B 13/00 172/698 |
| 4,321,970 | A * | 3/1982 | Thigpen | E02F 5/32 172/464 |
| 4,374,602 | A * | 2/1983 | Gurries et al. | E02F 5/326 299/14 |
| 4,991,659 | A * | 2/1991 | Stepe | A01B 13/08 172/464 |
| 7,399,039 | B2 | 7/2008 | Bettermann et al. | |
| 7,641,286 | B2 | 1/2010 | Siepenkort et al. | |
| 8,490,711 | B2 * | 7/2013 | Polumati | E02F 3/7604 172/484 |
| 2002/0104237 | A1 * | 8/2002 | Chaney | A01B 13/00 37/302 |

(Continued)

*Primary Examiner* — Tara Mayo-Pinnock

(74) *Attorney, Agent, or Firm* — Oblon, McClelland, Maier & Neustadt

(57) ABSTRACT

A retrieval arrangement for a ripper of a machine includes a bollard that is disposed towards a rear portion of the machine. The bollard includes a base that is disposed along a mid-plane of the ripper and connected to the ripper via a ripper carriage. A method for retrieving the ripper includes positioning a sling around the bollard, and pulling the sling using another machine such that the bollard is biased in the direction away from the ripper carriage.

16 Claims, 6 Drawing Sheets

(56) References Cited

U.S. PATENT DOCUMENTS

| | | | | |
|---|---|---|---|---|
| 2003/0014886 | A1* | 1/2003 | Chaney | A01B 13/00 37/302 |
| 2009/0188684 | A1 | 7/2009 | Parrish | |
| 2013/0161036 | A1* | 6/2013 | Polumati | E02F 5/32 172/663 |

* cited by examiner

RETRIEVAL ARRANGEMENT FOR A RIPPER OF A MACHINE

TECHNICAL FIELD

The present disclosure relates to a ripper assembly of a machine. More particularly, the present disclosure relates to a retrieval arrangement for a ripper of a machine.

BACKGROUND

Typically, machines that are fitted with a ripper may encounter instances when the ripper is stuck into the earth. In such instances, power from the machine's prime mover alone may be inadequate, or in other cases, less than optimum for use in retrieving the ripper out of the earth. In many cases, previously known configurations of retrieval systems have been retrofitted for use onto machines. However, operating procedures associated with one or more standards may dictate a performance of the retrieval system, or that the retrieval system be of a specific configuration and/or that the retrieval system be positioned at a specific location on the machine. Such standard, if complied with, could help ensure effectiveness in performance of the retrieval system besides improving its safety when used in retrieving the ripper of the machine that is stuck into the earth. However, it has been found that incorporation and use of numerous previously known configurations of retrieval systems was, at least partly, non-compliant with one or more standards pertaining to performance in a given environment.

Hence, there is a need for a retrieval arrangement for a ripper of a machine that overcomes the above-mentioned shortcomings, and incorporation and use of which would comply with one or more standards of performance required in the given field of use.

SUMMARY OF THE DISCLOSURE

In an aspect of this disclosure, a retrieval arrangement for a ripper of a machine includes a bollard that is disposed towards a rear portion of the machine, wherein the bollard includes a base that is disposed along a mid-plane of the ripper and connected to the ripper via a ripper carriage.

In another aspect of the present disclosure, a ripper assembly for a machine includes a ripper carriage, a ripper, and a bollard. The ripper carriage is disposed towards a rear portion of the machine. The ripper is supported by the ripper carriage, and the bollard is disposed towards the rear portion of the machine such that the bollard is connected to the ripper via the ripper carriage.

In yet another aspect of the present disclosure, a method for retrieving a ripper associated with a machine includes providing a push block at a rear portion of the machine such that the push block is connected to the ripper via a ripper carriage. The method also includes providing a bollard at the rear portion of the machine such that the bollard is connected to the ripper via the ripper carriage. The method then includes retrieving the ripper by applying a pushing force onto the push block using another machine such that the push block is biased in a direction away from the ripper carriage, or by positioning a sling around the bollard and pulling the sling using the other machine such that the bollard is biased in the direction away from the ripper carriage.

Other features and aspects of this disclosure will be apparent from the following description and the accompanying drawings.

DETAILED DESCRIPTION

Wherever possible, the same reference numbers will be used throughout the drawings to refer to same or like parts. Moreover, references to various elements described herein are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

The present disclosure relates to a ripper assembly of a machine. More particularly, the present disclosure relates to a retrieval arrangement for a ripper of a machine.

Figure 1:
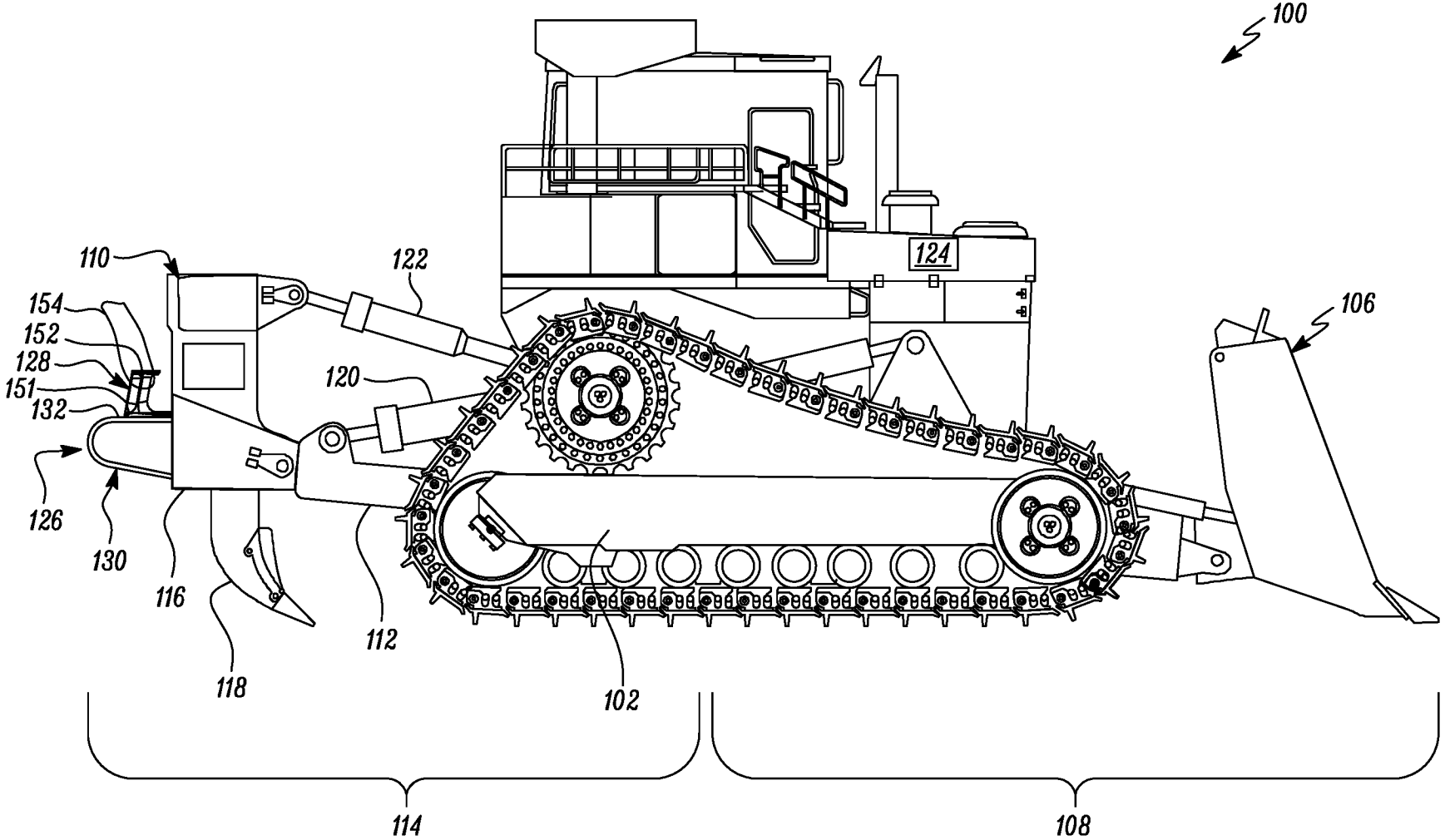
FIG. 1 is a side view of an exemplary machine having a ripper assembly and a retrieval arrangement for a ripper of the machine in accordance with embodiments of the present disclosure.

FIG. 1 depicts a machine 100 that is exemplarily embodied in the form of a track type tractor. Although a track type tractor is depicted in the view of FIG. 1, in other embodiments, other types of machines known to persons skilled in the art may be used in lieu of the track type tractor disclosed herein. Therefore, it may be noted that a type of machine used is merely exemplary in nature and hence, non-limiting of this disclosure.

As shown, the machine 100 includes a frame 102. Also, a pair of ground engaging members 104, for e.g., tracks are rotatably supported on the frame 102, of which, only one ground engaging member 104 is visible in the side view of FIG. 1. The tracks disclosed herein are merely exemplary in nature, and hence, non-limiting of this disclosure. In other embodiments, other types of ground engaging members, for example, wheels could be implemented in place of the tracks disclosed herein.

The machine 100 may include a work tool 106, for example, a blade disposed at a fore portion 108 of the machine 100. This work tool 106 would be pivotally connected to the frame 102 in order to allow for one or more functions, for example, pushing that are associated with the work tool 106 to be operatively performed by the machine 100.

Figure 2:
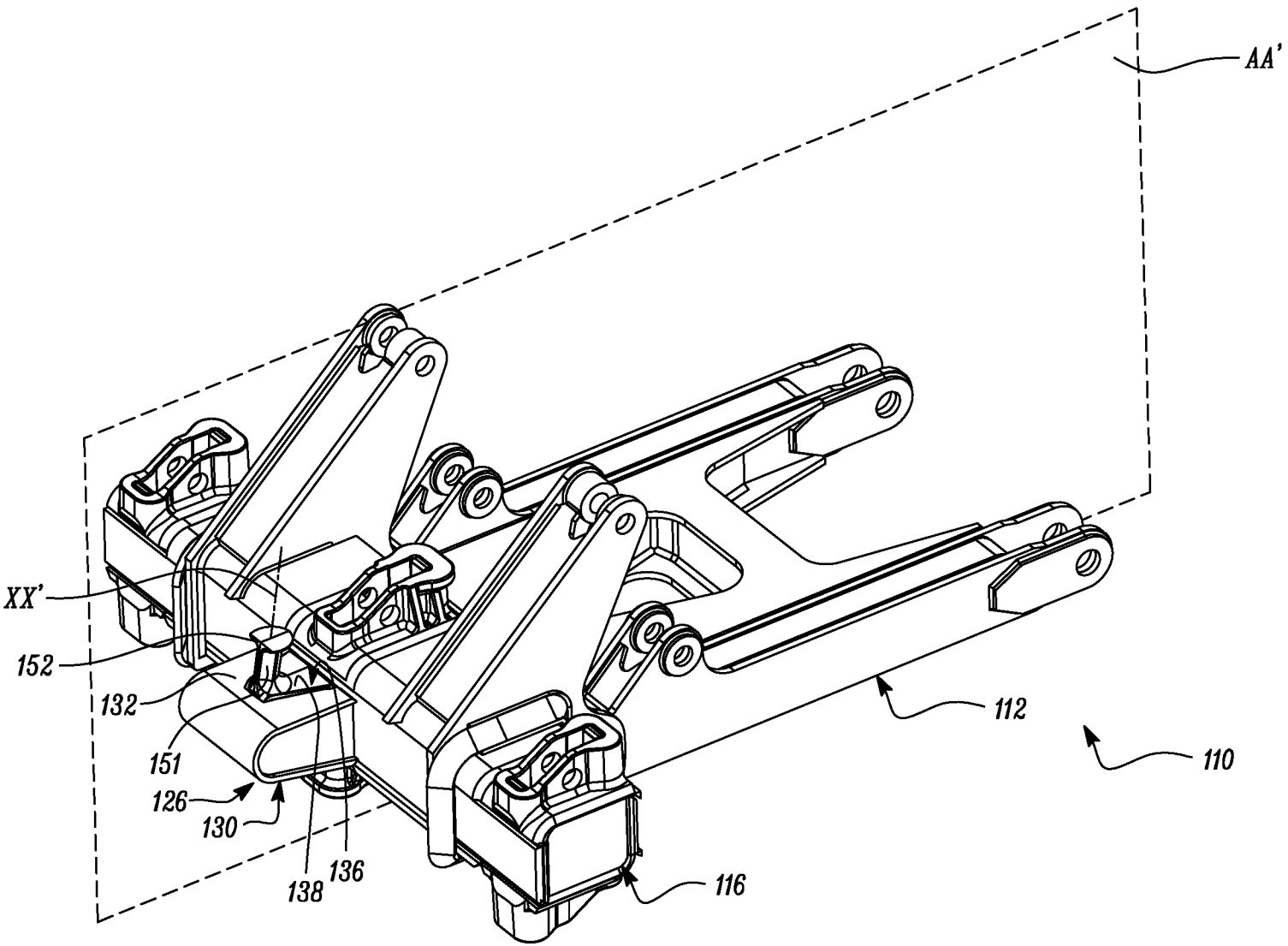
FIG. 2 is a rear perspective view of the ripper assembly from FIG. 1 showing a ripper frame, a ripper carriage and the retrieval arrangement in accordance with embodiments of the present disclosure.
Figure 3:
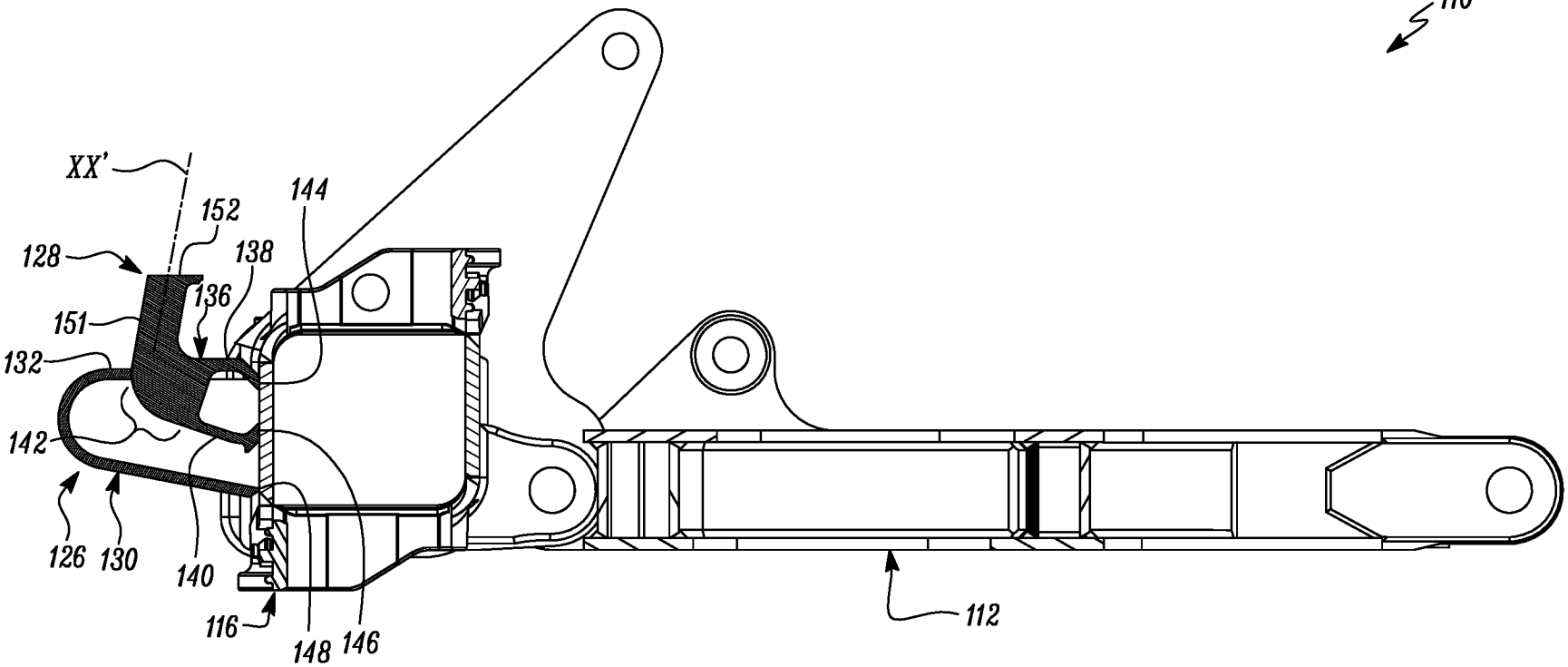
FIG. 3 is a sectional view of the ripper assembly taken along sectional mid-plane AA' of FIG. 2, the sectional view showing a push block and a bollard of the retrieval arrangement in accordance with embodiments of the present disclosure.

Referring to FIGS. 1-3, the machine 100 also includes a ripper assembly 110. The ripper assembly 110 could include a ripper frame 112 that could be disposed towards a rear portion 114 of the machine 100 and pivotally connect with the frame 102. As shown in FIG. 1, the ripper assembly 110 further includes a ripper carriage 116 that would also be disposed towards the rear portion 114 of the machine 100. The ripper carriage 116 would be configured to support a ripper 118 therein such that the ripper 118 depends downwardly from the ripper carriage 116.

In operation, a pair of lift and tilt cylinders 120, 122 pivotally connecting respective ones of the ripper frame 112 and the ripper carriage 116 to the frame 102 would be powered by a prime mover 124, for example, an internal combustion engine that would be present on the machine 100. Movement of these lift and/or tilt cylinders 120, 122 would, in turn, cause a movement of the ripper 118 relative to the frame 102 for operatively scarring, pecking, and/or ripping earth materials into smaller transportable pieces.

The ripper assembly 110 of FIGS. 1-5 also includes a retrieval arrangement 126 that has a bollard 128 disposed towards the rear portion 114 of the machine 100 and connected to the ripper 118 via the ripper carriage 116. Although not necessary, the retrieval arrangement 126 could also include a push block 130 as shown in the illustrated embodiment of FIGS. 1-5. This push block 130 would also be disposed towards the rear portion 114 of the machine 100 and connected to the ripper 118 via the ripper carriage 116. If present, this push block 130 would be attached, for example, by welding, to the ripper carriage 116, and would be configured to support, at least in part, the bollard 128 disclosed herein, explanation to which will be made in the appended disclosure.

Referring to FIGS. 1-5 and as best shown in FIG. 2, the push block 130 is arcuately shaped along a mid-plane AA' of the ripper 118. As shown best in FIG. 5, a top wall 132 of the push block 130 could be configured to define a cut-out 134 that would be configured to receive, at least partly therein, the bollard 128, and specifically, a base 136 of the bollard 128 therein.

Figure 4:
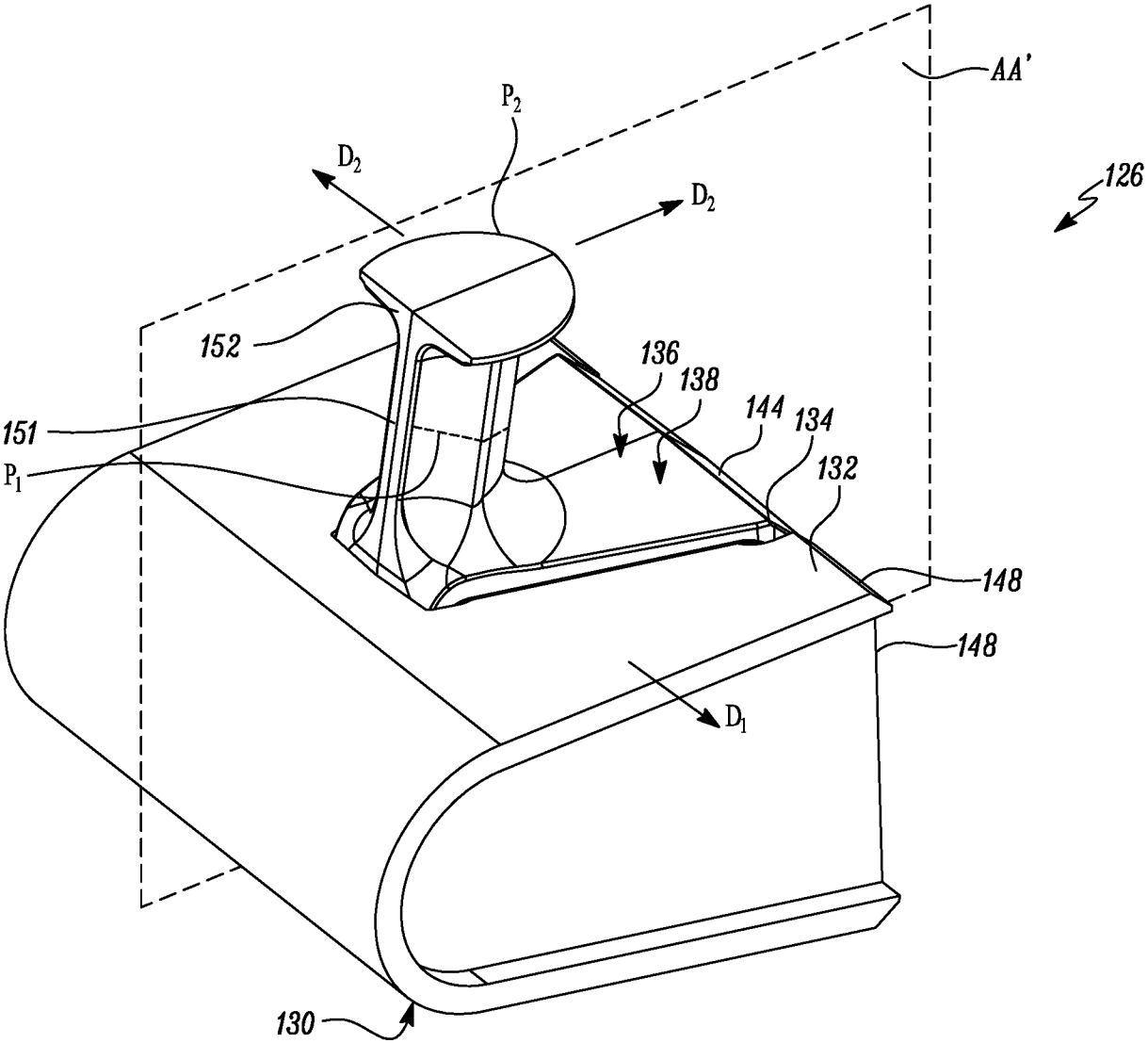
FIG. 4 is a zoomed-in rear perspective view of the retrieval arrangement taken from the view of FIG. 2.
Figure 5:
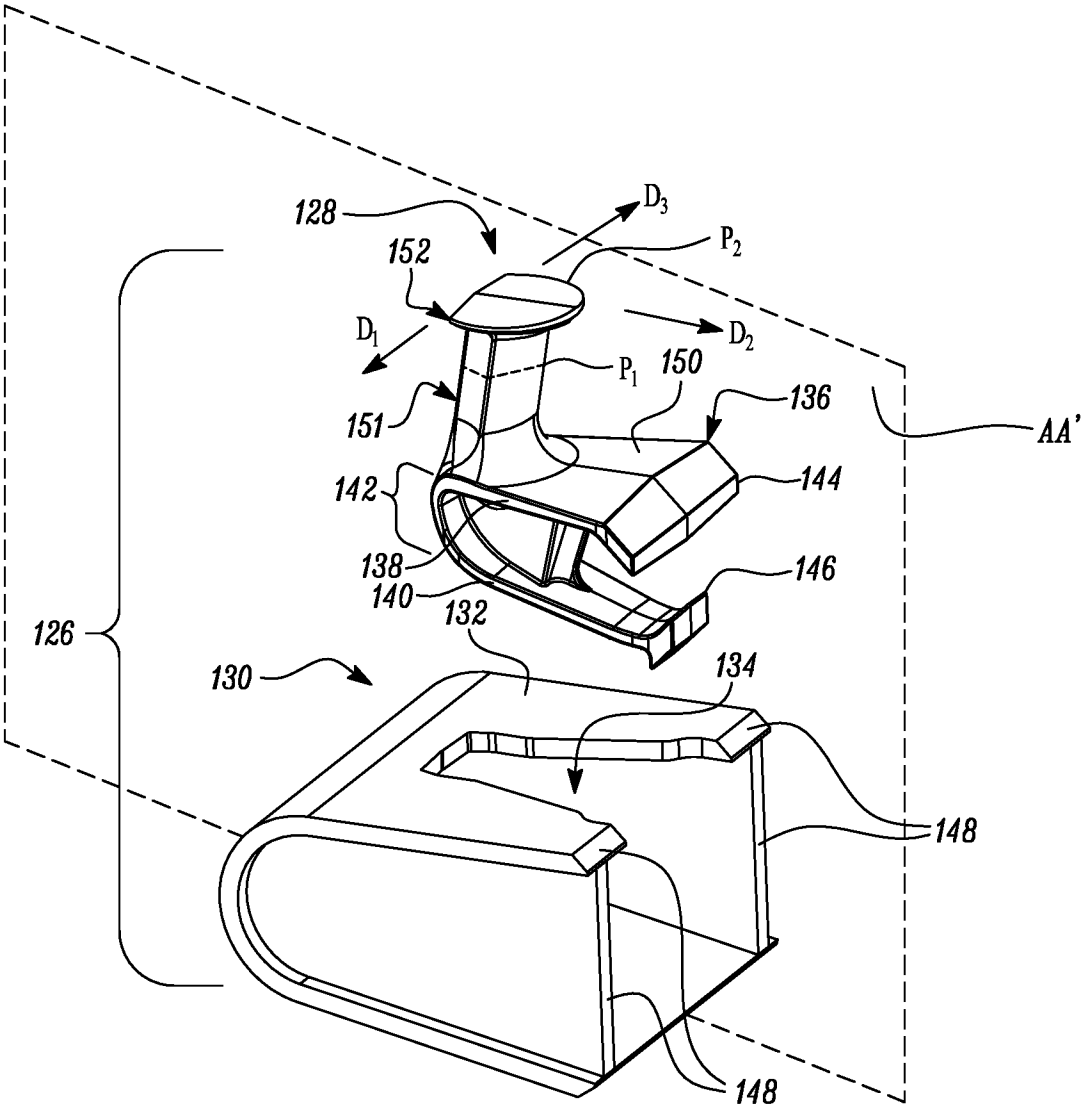
FIG. 5 is an exploded front perspective view of the retrieval arrangement showing a cut-out in the push block.

Referring to the illustrated embodiment of FIG. 5, the base 136 of the bollard 128 would be disposed along the mid-plane AA' of the ripper 118 and connected to the ripper 118 via the ripper carriage 116. Further, as shown, this base 136 would be arcuately shaped, and could have a first ledge member 138, and a second ledge member 140 that would be angularly disposed with the first ledge member 138 and may be connected to the first ledge member 138 by an arcuate mid-portion 142. Moreover, referring to FIGS. 3-5, and as best shown in FIG. 3, end portions 144, 146 of the first and second ledge members 138, 140 are configured to facilitate a weld with the ripper carriage 116 of the machine 100 located adjacent an end portion 148 of the push block 130. To that effect, as best shown in FIGS. 3 and 5, end portions 144, 146 of the first and second ledge members 138, 140 may also be angled towards each other.

Referring to FIGS. 1-5 and as best shown in FIGS. 4 and 5, the bollard 128 could be further configured to include a first portion 151 that protrudes upwardly from a top surface 150 of the base 136, specifically, the top surface 150 of the first ledge member 138 of the base 136. This first portion 151 would be located along a central axis XX'. In embodiments herein, the central axis XX' could be disposed at an angle $\alpha$ of about 45-90 degrees with respect to the base 136. In one example, the central axis XX' could be disposed at 90 degrees with respect to the base 136. Referring to the embodiment illustrated in the views of FIGS. 1-4, the central axis XX' could be disposed at, for example, 75 degrees with respect to the base 136. In yet other examples, the angle $\alpha$ between the central axis XX' and the base 136 could be 60 degrees, or 45 degrees, but is not limited thereto as the angle $\alpha$ may be selected to suit various requirements of an application.

Referring to FIGS. 1-5 and as best shown in FIGS. 4 and 5, the bollard 128 would also include a second portion 152 that extends from the first portion 151. Further, this second portion 152 would be disposed angularly with respect to the central axis XX'. Furthermore, a perimeter $P_2$ of the second portion 152 would be greater than a perimeter $P_1$ of the first portion 151 in at least one direction from the central axis XX'. As shown best in the views of FIGS. 4 and 5, the perimeter $P_2$ of the second portion 152 is generally greater than the perimeter $P_1$ of the first portion 151 radially across the directions $D_1$, $D_2$, and $D_3$. In embodiments herein, the first portion 151 of the bollard 128 would be configured to allow positioning of a sling 154 thereabout as shown in the view of FIG. 1, while the second portion 152 would be configured to bias the sling 154 from inadvertently coming off the first portion 151. To that effect, it may be noted that the extents to which the perimeter $P_2$ would be greater than the perimeter $P_1$ in each of the directions $D_1$, $D_2$, and $D_3$ may be selected based on various factors including, but not limited to, a thickness of the sling 154 that would be positioned around the first portion 151 of the bollard 128, and an amount of biasing force that would be required to prevent the sling 154 from slipping, or otherwise inadvertently coming off, off from the first portion 151 of the bollard 128 in operation.

Figure 6:
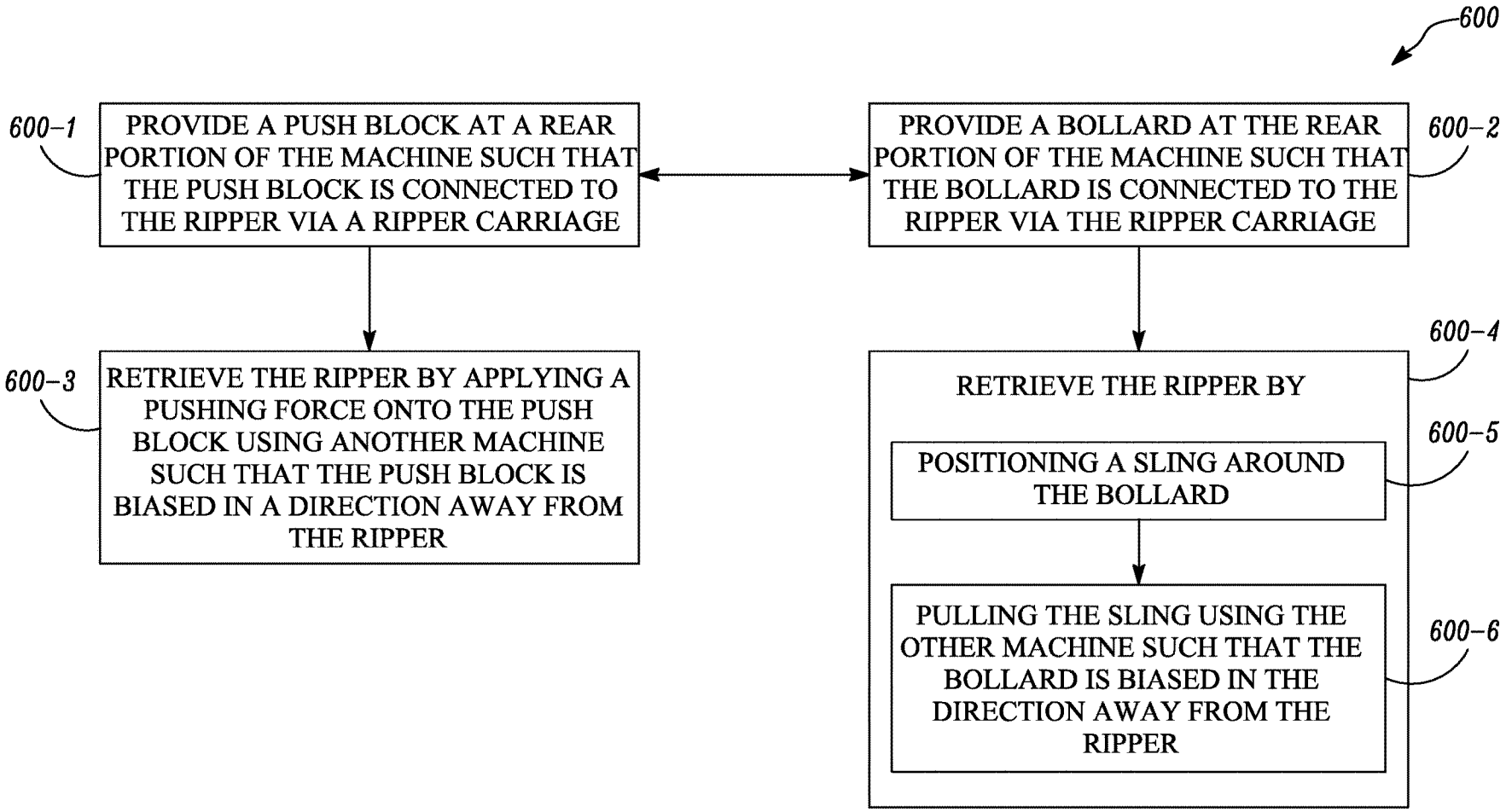
FIG. 6 illustrates a flowchart of a method for retrieving the ripper associated with the exemplary machine.

FIG. 6 illustrates a flowchart of a method 600 for retrieving the ripper 118 associated with a machine 100, for instance, the exemplary machine 100 disclosed herein. In embodiments herein, it may be noted that steps 600-1 and 600-2 of the method 600 may be carried out independent of each other. If step 600-1 of the method 600 is executed, then step 600-3 of the method 600 could be executed logically upon the execution of the step 600-1. Similarly, if step 600-2 of the method 600 is executed, then step 600-4 of the method 600 could be executed logically upon the execution of the step 600-2. In fact, it may be evident that the step 600-1 and the subsequent step 600-3 could together be separated from steps 600-2 and steps 600-4 for forming two distinct methods in lieu of the single method 600 disclosed herein.

As shown at step 600-1 in the method 600 of FIG. 6, the method 600 includes providing the push block 130 at the rear portion 114 of the machine 100 such that the push block 130 is connected to the ripper 118 via the ripper carriage 116. Subsequently, at step 600-3, the method 600 would then include retrieving the ripper 118 by applying a pushing force onto the push block 130 using another machine such that the push block 130 is biased in a direction away from the ripper carriage 116.

As shown at step 600-2 in the method 600 of FIG. 6, the method 600 includes providing the bollard 128 at the rear portion 114 of the machine 100 such that the bollard 128 is connected to the ripper 118 via the ripper carriage 116. Subsequently, at step 600-4, the method 600 includes retrieving the ripper 118 by positioning the sling 154 around the bollard 128 as shown at the sub-step 600-5 of the method 600, and thereafter pulling the sling 154 using the other machine such that the bollard 128 is biased in the direction away from the ripper carriage 116 as shown at the sub-step 600-6.

Various embodiments disclosed herein are to be taken in the illustrative and explanatory sense and should in no way be construed as limiting of the present disclosure. All joinder references (e.g., mounted, associated, connected and the like) are only used to aid the reader's understanding of the present disclosure, and may not create limitations, particularly as to the position, orientation, or use of the components disclosed herein. Therefore, joinder references, if any, are to be construed broadly. Moreover, such joinder references do not necessarily infer that two elements are directly connected to each other.

Additionally, all positional terms, such as, but not limited to, "fore", "rear", "downward", "first", "second" or any other ordinary and/or numerical terms, should also be taken only as identifiers, to assist the reader's understanding of the various elements, embodiments, variations and/or modifications of the present disclosure, and may not create any limitations, particularly as to the order, or preference, of any element relative to, or over, another element.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional components, such features may be omitted from the scope of the present disclosure without departing from the spirit of the present disclosure as defined in the appended claims.

INDUSTRIAL APPLICABILITY

In embodiments herein, although the bollard 128 can be used by attaching the bollard 128 alone onto the ripper carriage 116, for example, by welding the base 136 of the bollard 128 onto the ripper carriage 116, it should be noted that by providing the push block 130 in conjunction with the bollard 128, the bollard 128 can be supported in more than one direction, for example, in the directions $D_1$ and $D_3$ in addition to the direction $D_2$ disclosed herein. It is hereby envisioned that during operation, when the sling 154 is positioned about the first portion 151 of the bollard 128 and pulled by the other machine 100, forces that would act on the bollard 128 along the mid-plane AA' and hence, in the direction $D_2$ would be counteracted by the weld between the end portions 144, 146 of the base 136 of the bollard 128 and the ripper carriage 116. However, when these forces, or some components of these forces, as encountered by the bollard 128, do not act along the mid-plane AA', for example, in either of the directions $D_1$ or $D_3$, the weld between the end portion 148 of the push block 130 and the ripper carriage 116 could counteract such forces in addition to the weld between the bollard 128 and the ripper carriage 116. Therefore, it will be appreciated that in embodiments herein, the cut-out 134 in the top wall 132 of the push block 130 would not only be configured to help the push block 130 receive the base 136 of the bollard 128 therein, but also to restrain the bollard 128 from movement if forces act outside of the mid-plane AA'.

The present disclosure has applicability for use in facilitating operators of machines to retrieve rippers that are stuck into the earth. In some cases, push blocks may be readily used for pushing the ripper from out of the earth, partly, due to another machine having a suitable implement, for example, a blade, that can be forced against the push block such that the push block is biased in a direction away from the ripper carriage. In cases where the other machine has an implement other than a blade, for example, a hook, the bollard disclosed herein can be used to retrieve the stuck ripper by allowing operators to tie the sling around the bollard, particularly, the first portion of the bollard, and thereafter pull the sling using the other machine such that the bollard is biased in the direction away from the ripper carriage. This way, the retrieval arrangement of the present disclosure can reduce time, effort, and additional costs incurred when retrieving rippers stuck into the earth.

While aspects of the present disclosure have been particularly shown and described with reference to the embodiments above, it will be understood by those skilled in the art that various additional embodiments may be contemplated by the modification of the disclosed machines, systems, methods and processes without departing from the spirit and scope of what is disclosed. Such embodiments should be understood to fall within the scope of the present disclosure as determined based upon the claims and any equivalents thereof.

What is claimed is:

1. A retrieval arrangement for of a ripper of a machine, the retrieval arrangement of the ripper of the machine comprising:

a bollard disposed towards a rear portion of the machine, wherein the bollard includes a base that is attached along a mid-plane of the ripper and connected to the ripper via a ripper carriage, wherein the base is arcuately shaped, and the bollard includes:

a first portion protruding upwardly from a top surface of the base, the first portion located along a central axis that is disposed at an angle of about 45-90 degrees with respect to the base; and a second portion extending from the first portion and disposed angularly with respect to the central axis, and wherein the base has a first ledge member, and a second ledge member that is angularly disposed with the first ledge member and connected to the first ledge member by an arcuate mid-portion.

2. The retrieval arrangement of claim 1, wherein a perimeter of the second portion is greater than a perimeter of the first portion in at least one direction from the central axis.

3. The retrieval arrangement of claim 2, wherein the first portion is configured to allow positioning of a sling thereabout while the second portion is configured to bias the sling from inadvertently coming off the first portion.

4. The retrieval arrangement of claim 1 further comprising a push block disposed towards the rear portion of the machine such that the push block is connected to the ripper.

5. The retrieval arrangement of claim 4, wherein the push block is arcuately shaped along the mid-plane of the ripper.

6. The retrieval arrangement of claim 5, wherein a top wall of the push block defines a cut-out configured to receive, at least partly, the base of the bollard.

7. The retrieval arrangement of claim 4, wherein end portions of the first and second ledge members are configured to facilitate a weld with the ripper carriage of the machine located adjacent an end portion of the push block.

8. The retrieval arrangement of claim 7, wherein end portions of the first and second ledge members are angled towards each other.

9. A ripper assembly for of a machine, the ripper assembly of the machine comprising:

a ripper carriage disposed towards a rear portion of the machine;

a ripper supported by the ripper carriage; and a bollard disposed towards the rear portion of the machine such that the bollard is connected to the ripper via the ripper carriage, wherein the bollard includes:

a base arcuately shaped along a mid-plane of the ripper;

a first portion protruding upwardly from a top surface of the base, the first portion located along a central axis that is disposed at an angle of about 45-90 degrees with respect to the base; and a second portion that extends from the first portion and is disposed angularly with respect to the central axis, and wherein the base has a first ledge member, and a second ledge member that is angularly disposed with the first ledge member and connected to the first ledge member by an arcuate mid-portion.

10. The ripper assembly of claim 9, wherein a perimeter of the second portion is greater than a perimeter of the first portion in at least one direction from the central axis such that while the first portion is configured to facilitate positioning of a sling thereabout, the second portion is configured to bias the sling from inadvertently coming off the first portion.

11. The ripper assembly of claim 9 further comprising a push block disposed towards the rear portion of the machine such that the push block is connected to the ripper.

12. The ripper assembly of claim 11, wherein the push block is arcuately shaped along the mid-plane of the ripper.

13. The ripper assembly of claim 12, wherein a top wall of the push block defines a cut-out configured to receive, at least partly, the base of the bollard.

14. The ripper assembly of claim 11, wherein end portions of the first and second ledge members are configured to facilitate a weld with the ripper carriage of the machine located adjacent an end portion of the push block.

15. The ripper assembly of claim 14, wherein end portions of the first and second ledge members are angled towards each other.

16. A method for retrieving a ripper associated with a machine, the method comprising:

providing a push block at a rear portion of the machine such that the push block is connected to the ripper via a ripper carriage;

providing a bollard at the rear portion of the machine such that the bollard is connected to the ripper via the ripper carriage;

retrieving the ripper by performing:

positioning a sling around the bollard, and pulling the sling using the other machine such that the bollard is biased in the direction away from the ripper carriage.

* * * * *